US005629273A

United States Patent [19]

Hauenstein

[11] Patent Number: 5,629,273

[45] Date of Patent: May 13, 1997

[54] SILICONE-POLYBUTYLENE BLENDS

[75] Inventor: Dale E. Hauenstein, Midland, Mich.

[73] Assignee: Dow Corning Incorporated, Midland, Mich.

[21] Appl. No.: 630,291

[22] Filed: Apr. 10, 1996

Related U.S. Application Data

[63] Continuation-in-part of Ser. No. 317,945, Oct. 4, 1994, abandoned.

[51] Int. Cl.[6] ..... C10M 155/02

[52] U.S. Cl. ..... 508/208; 252/78.3

[58] Field of Search ..... 252/78.3; 508/208; C10M 155/02

[56] References Cited

U.S. PATENT DOCUMENTS

| | | | |
|---|---|---|---|
| 2,356,367 | 8/1944 | Wright . | |
| 2,375,007 | 5/1945 | Larsen . | |
| 2,398,187 | 4/1946 | McGregor . | |
| 2,466,642 | 4/1949 | Larsen . | |
| 2,773,034 | 12/1956 | Bartleson . | |
| 3,328,482 | 6/1967 | Northrup | 524/490 |
| 3,697,440 | 10/1972 | Lichtman . | |
| 3,816,313 | 6/1974 | Szieleit . | |
| 3,959,175 | 5/1976 | Smith, Jr. . | |
| 4,059,534 | 11/1977 | Morro . | |
| 4,097,393 | 6/1978 | Cupper | 272/78.3 |
| 4,514,319 | 4/1985 | Kulkarni . | |

FOREIGN PATENT DOCUMENTS

| | | |
|---|---|---|
| 1100931 | 10/1978 | Canada . |
| 529161 | 8/1991 | European Pat. Off. . |
| 63-199277 | 2/1987 | Japan . |
| 1490240 | 12/1973 | United Kingdom . |

OTHER PUBLICATIONS

Polymer Blends, by Sandra Krause, vol. 1, (1978) p. 86.

The Miscibility of Polymers: I. Phase Equilibria in Systems Containing Two Polymers and a Mutual Solvent, by Allen, Gee and Nicholson (1959) pp. 56–62.

The Miscibility of Polymers: II. Miscibility and Heat of Mixing Up Liquid Polyisobutenes and Silicones, by Allen, Gee and Nicholson (1960) pp. 10–17.

Synthetic Lubricants and High–Performance Functional Fluids, Marcel Dekker, Inc. (1993) p. 279.

The Panalane Advantage, Amoco, (1992) pp. 2–8.

Macromolecules, vol. 8, No. 3, May–Jun. 1975, pp. 371–373.

*Primary Examiner*—Prince Willis, Jr.
*Assistant Examiner*—Cephia D. Toomer
*Attorney, Agent, or Firm*—Alexander Weitz

[57] ABSTRACT

The present invention relates to a fluid comprising a compatible blend of (A) a polydimethylsiloxane and (B) a polybutylene wherein the viscosities of these two components are substantially identical such that the viscosity of the blend is less than the viscosity of either component (A) or (B), each viscosity being measured at the same operating temperature and pressure. This synergistic viscosity reduction is enhanced when particular moieties are present in the polydimethylsiloxane and/or polybutylene components and as the polydispersity of the polydimethylsiloxane is increased.

19 Claims, No Drawings

SILICONE-POLYBUTYLENE BLENDS

This is a Continuation-In-Part Application of Ser. No. 08/317,945 filed on Oct. 4, 1994, now abandoned.

FIELD OF THE INVENTION

The present invention relates to blends of silicone oil with polybutylene. More particularly, the invention relates to homogeneous blends of a polydimethylsiloxane oil and polybutylene, wherein these components are selected such that their viscosities are approximately identical under the conditions of application, whereby the viscosity of the blend is lower than that of either pure component.

BACKGROUND OF THE INVENTION

Many applications for hydraulic fluids require that the viscosity of the fluid change as little as possible over the intended operating temperature range. Silicone fluid, and polydimethylsiloxane fluids in particular, are known to have a low viscosity variation with temperature relative to organic oils. This property, along with its thermal and oxidative stability, would thus be expected to make polydimethylsiloxane (PDMS) oil a highly desirable hydraulic fluid, and an example of this utility may be found in U.S. Pat. No. 2,398,187 to McGregor et al. However, in applications involving metal components which undergo relative motion, the utility of PDMS oil is largely constrained by the fact that it is a particularly poor metal lubricant (e.g., in steel-to-steel contact). This results in unacceptable wear of the metal surfaces, particularly at elevated temperatures and under high load conditions.

Efforts have been made to improve the lubricating properties of PDMS oils and the inclusion of various hydrocarbon oils and lubricity additives has been successful to some degree.

Morro et al., in U.S. Pat. No. 4,059,534, describe hydrocarbon/silicon (sic) oil lubricating compositions for low temperature use wherein polydimethylsiloxane is mixed with an alkene, isoparaffin or naphthenic oil.

In Canadian Patent Number 1,100,931 to Morro and Rathgeber, similar silicone/hydrocarbon blends are disclosed wherein a high viscosity polydimethylsiloxane is combined with a blend of a low viscosity polydimethylsiloxane and a hydrocarbon oil. These blends are said to have excellent viscosity-temperature characteristics and low temperature stability.

In another similar disclosure, U.S. Pat. No. 4,097,393 to Cupper et al. teaches lubricant and hydraulic fluid compositions consisting essentially of polydimethylsiloxane and particular hydrocarbon oils, wherein blends of these components remain miscible at −40° C. for at least 72 hours.

However, certain hydraulic applications for fluids of the type described above (e.g., gas compressors, hydraulically actuated brakes and controls) are directed to systems wherein the temperature of the working fluid is maintained within a relatively narrow range. Under such conditions, a hydraulic fluid should have the lowest absolute viscosity consistent with other requirements of lubricity, stability and low temperature fluidity. Thus, a reduction in fluid viscosity translates directly into a reduction in the viscous power loss (i.e., cost, fuel conservation) associated with the operation of the hydraulic device. This reduction is particularly appreciated at low temperatures where the fluids exhibit significantly greater viscosities.

SUMMARY OF THE INVENTION

It has now been discovered that, when a polydimethylsiloxane oil of a given viscosity is mixed with a polybutylene oligomer of approximately identical viscosity, the resulting blend has a viscosity lower than either the polydimethylsiloxane or the polybutylene individually, each viscosity being measured at the same operating temperature and pressure. This surprising synergistic viscosity reduction is more pronounced when silanol end groups are substituted for trialkylsilyl end group on the polydimethylsiloxane component and/or when the polybutylene component is terminated with an epoxy group. Furthermore, an even greater reduction of viscosity is obtained as the polydispersity of the polydimethylsiloxane component is increased. This phenomenon is not observed when the viscosities of the polydimethylsiloxane and the polybutylene are not substantially the same at the temperature in question. Under these circumstances, the viscosity of the blend is, as expected, between those of the individual components. It has also been shown that some of the instant compositions exhibit lubricity in metal-to-metal contact which is considerably better than would be expected from a linear combination of the polydimethylsiloxane and polybutylene components.

The present invention, therefore, relates to a hydraulic fluid comprising a compatible blend of (A) a polydimethylsiloxane having a viscosity V; and (B) a polybutylene having a viscosity substantially identical with V, wherein the ratio of said polydimethylsiloxane (A) to said polybutylene (B) is such that the viscosity of said blend is less than the viscosity of either component (A) or (B), each viscosity being measured at the same operating temperature and pressure.

The invention further relates to a method for moving a member positioned within an enclosing chamber comprising transmitting pressure to said member through the above described hydraulic fluid.

The invention also relates to a method for reducing the frictional wear of metal surfaces, said method comprising applying to at least a portion of said metal surfaces the above blend of polydimethylsiloxane and polybutylene.

The invention still further relates to the use of the above hydraulic fluid as a thread lubricant or as a lubricant compressor fluid in a gas compressor.

DETAILED DESCRIPTION OF THE INVENTION

Component (A) of the invention is at least one polydimethylsiloxane (PDMS) polymer or copolymer having a maximum viscosity at 25° C. of about 10,000 cP (mPa-s), preferably about 2 to about 1,000 cP, and most preferably about 10 to about 500 cP. For the purposes of the present invention, the polydimethylsiloxane can also comprise up to about 15 mole percent of diorganosiloxane units or monoorganosilsesquioxane (i.e., branching) units. Examples of suitable organic radicals of these optional siloxane units include alkyl radicals, such as ethyl, propyl, pentyl, octyl, undecyl and octadecyl; cycloaliphatic radicals, such as cyclohexyl; aryl radicals such as phenyl, tolyl, xylyl, benzyl, alphamethyl styryl and 2-phenylethyl; alkenyl radicals such as vinyl; and chlorinated hydrocarbon radicals such as 3-chloropropyl, 3,3,3-trifluoropropyl and dichlorophenyl. It is preferred that at least 50%, and preferably at least 85%, of the organic radicals along the chain of component (A) are methyl radicals.

The selection of terminal groups on polydimethylsiloxane (A) is not critical for the operability of the present invention but does influence the degree of viscosity reduction. Preferably, the end groups are trihydrocarbylsilyl groups of the formula —$OSiR'_3$, wherein R' is independently selected from alkyl radicals having 1 to 10 carbon atoms or phenyl. In this case, it is preferred that R' is methyl radical based on the availability and low cost of such polymers. When a greater viscosity reduction is desired, the terminal groups are selected from dialkylhydroxysilyl groups of the formula —$OSi(R')_2OH$, wherein R' is as defined above. Most preferably, the terminal groups are dimethylhydroxysilyl. Other suitable terminal groups include aminoalkyldialkylsilyl, such as aminopropyldimethylsilyl, dimethylphenylsilyl, dimethylvinylsilyl, dimethylhexenylsilyl, dimethylhydrogenysilyl, dimethylalkoxysilyl, methyldialkoxysilyl and trialkoxysilyl, wherein the alkoxy groups have 1 to 6 carbon atoms and are preferably methoxy. A highly preferred component (A) is a polydimethylsiloxane homopolymer which is capped with a dimethylhydroxysilyl group at each molecular chain end and has a viscosity of <500 cP at 25° C.

Component (A) is well known in the art and many such polymers and copolymers are available commercially.

Component (B) of the invention is a polybutylene (PB) oligomer or polymer having a number average molecular weight (MW) of about 100 to about 3,000, preferably about 200 to about 1,700, more preferably about 200 to about 800 and most preferably about 300 to about 500.

Polybutylene (B) can comprise repeat units having the following formulas

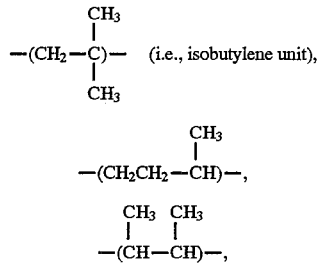

(i.e., isobutylene unit), as well as rearranged products such as

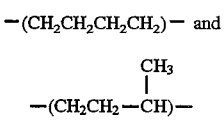

and

Preferably, a predominant proportion (e.g., >50 mole %) of the repeat units of (A) are isobutylene units. Polybutylene (A) may have fully saturated end groups or it may contain at least one functional group located at its molecular chain end or along its chain. Examples of suitable functional groups include epoxy, anhydride, halide, alkoxyphenylene, hydroxyl, carboxyl, chlorosilyl, isocyanato, amino, amido and unsaturated groups such as 2-methyl-2-propenyl. These polymers are known in the art and many are available commercially in a variety of molecular weight and end group combinations. For example, PB containing an unsaturated group is available in a variety of molecular weights from the Amoco Chemical Company (Chicago, Ill.) under the trade name Indopol™, from BASF Aktiengesellschaft (Germany) under the trade name Glissopal™ and from BP Chemicals (London) under the trade name Ultravis™.

Highly preferred polybutylene (B) contains one epoxy group, this group being located predominantly at a molecular chain end. Such polymers are also available from the Amoco Chemical Company under the trade name Actipol™. These materials result in blends of the invention which exhibit a greater viscosity reduction than those based on fully saturated PB or PB containing the above described unsaturated groups.

In order to prepare the compositions of the present invention it is necessary to first determine the absolute viscosity of one of the components (e.g., the polydimethylsiloxane) under the intended condition of operation (i.e., temperature and pressure). This first component is then thoroughly mixed with the second component (e.g., the polybutylene) which has a substantially identical absolute viscosity at the above mentioned operating condition. For the purposes of the present invention, the terminology "substantially identical" is used to indicate that the absolute viscosities of the two components are either actually identical or close enough in value such that the resulting blend absolute viscosity is measurably less than the viscosity of either individual component at the same temperature and pressure. It is preferred that, when the absolute viscosity of polydimethylsiloxane (A) is represented by V, the absolute viscosity of polybutylene (B) is 0.75 V to 1.25 V, preferably 0.85 V to 1.15 V, most preferably exactly V. The method of mixing and order of addition are not critical. However, in order to be within the scope of the present invention, the blends must form stable, compatible systems wherein the two components do not readily phase separate upon standing under ordinary ambient conditions. It is contemplated that a blend which has not phase separated upon standing for at least six months at 25° C. is a compatible mixture of components (A) and (B) as defined herein.

Although the reduction of blend viscosity is observed over the complete range of (A):(B) ratios, this effect is generally quite small when less than about 1 weight percent of either component is used. It is therefore preferred that the blend weight ratio of (A) to (B) be in the range 1:99 to 99:1, preferably 10:90 to 90:10, more preferably 25:75 to 75:25 and most preferably about 50:50. When approximately equal proportions of (A) and (B) are blended, the greatest reduction of blend viscosity is obtained. Also, as mentioned above, there is a further reduction of the blend viscosity as the polydispersity of polydimethylsiloxane (A) is increased. When the polydispersity (i.e., weight average molecular weight divided by number average molecular weight) of (A) is equal to or greater than about 10, preferably greater than about 30, there is a dramatic reduction in the blend viscosity. Such a high polydispersity of polydimethylsiloxane (A) is readily achieved by blending high and low viscosity polydimethylsiloxanes to obtain the desired viscosity for the application under consideration.

In addition to the two above described components, the blends of the present invention can further comprise various lubricity additives, such as halogenated organic compounds, sulfur compounds, phosphorus compounds, dyes, antioxidants, rust inhibitors, thickeners and fillers.

The above described blend may be used as a hydraulic fluid for transmitting pressure or force in an apparatus comprising movable member positioned within an enclosed chamber, thereby causing the member to move. An example of such an apparatus is a hydraulic lift, jack or press. In this system, the hydraulic fluid is pressurized in a compressor or pump and allowed to communicate with a piston/cylinder assembly via high pressure lines, thereby transmitting pressure to the piston and causing it to move with respect to the cylinder. Other examples of devices using this principle include hydraulic brakes and power steering pumps.

The instant hydraulic fluid also find utility as viscous coupling fluid in devices such as fan clutches, viscous drives and traction drives. It may also be used as a shock absorber fluid or as a torsional vibration damper, these applications being particularly appropriate at low temperatures.

The composition of the invention may also be used as a lubricant wherein the frictional wear of metal surfaces are reduced by applying the above described blend to at least a portion of a first metal surface in an area which contacts a second metal surface. For example, the fluid according to the instant invention may be used as a lubricating compressor fluid in a gas (e.g., air, refrigeration gas) compressor. In addition to lubricating the moving parts of the compressor, the fluid provides a good gas seal.

Further, the compositions of the invention may be used as a thread lubricant in sewing and thread or textile manufacturing, wherein the blends are applied to the needle or thread in order to reduce friction, wear and overheating in these operations. The thread in these operations is formed from a fiber selected from the non-limiting group: polyesters (e.g., polyethylene terephthalate); nylon (e.g., nylon-6, nylon-6,6, nylon-11); polypropylene; polyurethanes (e.g., Spandex™); acrylics (e.g., polyacrylonitrile); and cellulosics (cellulose acetate, cellulose diacetate, cellulose triacetate, regenerated cellulose).

EXAMPLES

The following examples are presented to further illustrate the hydraulic compositions and method of this invention, but are not to be construed as limiting the invention, which is delineated in the appended claims. All parts and percentages in the examples are on a weight basis and measurements were carried out at approximately 25° C., unless indicated to the contrary.

SAMPLE PREPARATION

Blends were prepared by mixing polydimethylsiloxane with polyisobutylene in 16 ounce jars. Mixing was accomplished by shaking, using a Whatman™ mini-mixer, stirring with a spatula, or a combination of these techniques, to provide compatible blends. The components used were:

PDMS-1 is a polydimethylsiloxane terminated at each molecular chain end with a trimethylsilyl group.

PDMS-2 is a polydimethylsiloxane terminated at each molecular chain end with a dimethylhydroxysilyl group.

PDMS-3 is a polydimethylsiloxane terminated at each molecular chain end with an aminopropyldimethylsilyl group. Particular fluids used, and their respective kinematic viscosities, were: DSM-A12 (20 cS), DSM-A15 (50 cS), DSM-A21 (100 cS) and DSM-A32 (2,000 cS); these were obtained from Gelest, Inc. of Tullytown, Pa. Intermediate viscosities were prepared by blending these fluids.

Indopol™ L-14 is described as a polyisobutylene (PIB) having a number average molecular weight of about 320 and one end capped with an unsaturated group of the formula $—HC{=}C(CH_3)_2$ (i.e., 2-methyl-2-propenyl). It is a product of the Amoco Chemical Company, Chicago, Ill.

Actipol™ E-6 is described as a polyisobutylene having a number average molecular weight of about 365 and one end capped with an epoxy group. It is also a product of the Amoco Chemical Company.

Polysynlane™ is described as a saturated polyisobutylene having a number average molecular weight of about 320 and is a product of Polyesther Corporation, Southhampton, N.Y.

VISCOSITY MEASUREMENTS

Kinematic viscosities (i.e., $cS=(mm)^2/s$) were determined at the indicated temperatures using a series of calibrated Cannon-Fenske viscometers. Temperature was controlled in a water bath to within 0.02° C. Efflux times agreed to within 0.1% (average). Kinematic viscosities were converted to absolute viscosities using relative density measurements obtained from readings with the appropriate hydrometer at the indicated temperature. All viscosities reported herein are in units of cP=mPa-s, unless indicated to the contrary. When the absolute viscosities of the individual components was matched, the percent reduction of the blend viscosity relative to the average of the component viscosities is reported as "% Drop."

POLYDISPERSITY MEASUREMENTS

Polydispersity (PD) of the polydimethylsiloxanes was determined by gel permeation chromatography (GPC). PDMS calibration and toluene solvent were used for the PDMS-1 and PDMS-2 samples; polystyrene calibration and tetrahydrofuran (THF) solvent were employed in the GPC for PDMS-3 samples after these were endcapped with acetic anhydride. Polydispersity of the PIB samples was determined by GPC using PIB calibration standards.

LUBRICITY MEASUREMENTS

Lubricity was measured by the 4-Ball Wear Test (ASTM 2266). The wear scar major diameter (W) was measured on six balls (two runs, three steel balls per test) using a load of 40 Kg at 75° C. at 1,200 r.p.m. for one hour, the results being averaged and reported in mm.

EXAMPLE 1

Table 1 shows the absolute viscosities of various 50:50 blends of PDMS-1 and Indopol™ L-14, as well as viscosities of the individual components, at room temperature (25.4° C).

TABLE 1

| Viscosity Indopol ™ L-14 | Viscosity PDMS-1 | Viscosity 50:50 Blend |
|---|---|---|
| 47.40 | 9.46 | 16.11 |
| 47.40 | 18.10 | 23.12 |
| 47.40 | 47.40 | 39.38 |
| 47.40 | 206.28 | 99.03 |
| 47.40 | 333.95 | 131.09 |

When the absolute viscosities of the individual components were matched (at 47.40 cP), the resulting absolute viscosity of the blend was 17% lower than either individual viscosity.

EXAMPLE 2

Table 2 shows similar results to those of Example 1 using 50:50 blends of PDMS-1 and Polysynlane™ at room temperature (25.5° C.). A 68:32 mixture of 20 cS and 50 cS polydimethylsiloxanes was used to match the Polysynlane™ viscosity.

TABLE 2

| Viscosity Polysynlane ™ | Viscosity PDMS-1 | Viscosity 50:50 Blend |
|---|---|---|
| 27.50 | 9.46 | 12.96 |
| 27.50 | 18.10 | 18.20 |
| 27.50 | 27.35 | 22.71 |
| 27.50 | 206.28 | 77.42 |
| 27.50 | 333.95 | 103.78 |

When component viscosities were matched the resulting blend viscosity was 17% lower than that of each component.

EXAMPLE 3

Table 3 shows similar results to those of Example 1 using 50:50 blends of PDMS-1 and Actipol™ E-6 at room temperature (25.4° C.). A 50:50 mixture of 50 cS and 350 cS PDMS-1 was used to match the Actipol™ E-6 viscosity.

TABLE 3

| Viscosity Actipol ™ E-6 | Viscosity PDMS-1 | Viscosity 50:50 Blend |
|---|---|---|
| 139.93 | 9.46 | 22.26 |
| 139.93 | 18.10 | 32.41 |
| 139.93 | 140.32 | 111.77 |
| 139.93 | 206.28 | 134.46 |
| 139.93 | 333.95 | 189.49 |

When component viscosities were substantially matched the resulting blend viscosities were up to 20% lower than the viscosities of the components.

EXAMPLE 4

The components of Example 2 were used to prepare the first blend reported in Table 4 wherein the viscosity of the PDMS-1 was matched to the viscosity of the Polysynlane™ at the indicated temperature. The second and third PDMS-1 fluids were 20 cS and 10 cS fluids, respectively.

TABLE 4

| Temp. (°C.) | Viscosity Polysynlane ™ | Viscosity PDMS-1 | Viscosity 50:50 Blend | % Drop |
|---|---|---|---|---|
| 25.5 | 27.50 | 27.35 | 22.71 | 17 |
| 40.5 | 13.80 | 13.80 | 11.78 | 15 |
| 80.0 | 3.96 | 3.96 | 3.69 | 7 |

It can be seen that the percent drop of blend viscosity relative to the component viscosity was less at the higher temperatures.

EXAMPLE 5

Similar results to those of Example 4 were observed with blends of PDMS-1 and Indopol™ L-14 as shown in Table 5.

TABLE 5

| Temp. (°C.) | Viscosity Indopol ™ L-14 | Viscosity PDMS-1 | Viscosity 50:50 Blend | % Drop |
|---|---|---|---|---|
| 25.4 | 47.40 | 47.40 | 39.38 | 17 |
| 60.7 | 9.84 | 9.84 | 8.79 | 11 |

EXAMPLE 6

Similar results to those of Example 4 were observed with blends of PDMS-1 and Actipol™ E-6 as shown in Table 6.

TABLE 6

| Temp. (°C.) | Viscosity Actipol ™ E-6 | Viscosity PDMS-1 | Viscosity 50:50 Blend | % Drop |
|---|---|---|---|---|
| 25.4 | 139.93 | 140.32 | 111.77 | 20 |
| 92.5 | 6.18 | 6.18 | 5.72 | 8 |

EXAMPLE 7

The effect of PDMS functionality using matched component viscosities for 50:50 PDMS:Actipol™ E-6 blends at 25.4° C. is reported in Table 7.

TABLE 7

| PDMS Type | Viscosity Actipol ™ E-6 | Viscosity PDMS | Viscosity 50:50 Blend | % Drop |
|---|---|---|---|---|
| PDMS-2 | 139.93 | 139.25 | 105.28 | 25 |
| PDMS-1 | 139.93 | 140.32 | 111.77 | 20 |
| PDMS-3 | 139.93 | 139.51 | 115.27 | 18 |
| PDMS-3 (repeated) | 139.93 | 139.96 | 116.07 | 17 |

It is believed that an increase in the acidic nature of the PDMS functionality results in a greater percent drop of blend viscosity (i.e., viscosity reduction is in the order: silanol>trimethyl>aminopropyl).

EXAMPLE 8

The effect of PDMS functionality using matched component viscosities for 50:50 PDMS:Polysynlane™ blends at 25.5° C. is reported in Table 8.

TABLE 8

| PDMS Type | Viscosity Polysynlane ™ | Viscosity PDMS | Viscosity 50:50 Blend | % Drop |
|---|---|---|---|---|
| PDMS-1 | 27.50 | 27.35 | 22.71 | 17 |
| PDMS-3 | 27.50 | 27.50 | 22.38 | 19 |

EXAMPLE 9

The effect of component ratio on viscosity reduction (% drop) for blends of PDMS-1 and Polysynlane™ having matching viscosities at 25.5° C. is reported in Table 9. A 68:32 mixture of 20 cS and 50 cS PDMS-1 was used to match the Polysynlane™ viscosity.

TABLE 9

| PDMS-1:Polysynlane ™ Ratio | % Drop |
|---|---|
| 90:10 | 9 |
| 70:30 | 17 |
| 50:50 | 17 |
| 30:70 | 15 |
| 10:90 | 7 |

It can be seen that the greatest viscosity reduction is obtained when approximately equal portions of the components are used.

EXAMPLE 10

The effect of component ratio on viscosity reduction for blends of PDMS-3 (27.50 cP) and Polysynlane™ having matching viscosities at 25.5° C. is reported in Table 10. A 89:11 mixture of DMS-A11 (20 cS) and DMS-A15 (50 cS) was used to match the Polysynlane™ viscosity.

TABLE 10

| PDMS-3:Polysynlane ™ Ratio | % Drop |
|---|---|
| 90:10 | 8 |
| 70:30 | 16 |
| 50:50 | 19 |
| 30:70 | 16 |
| 10:90 | 7 |

EXAMPLE 11

The effect of component ratio on viscosity reduction for blends of PDMS-1 (140.32 cP) and Actipol™ E-6 (139.93 cP) having matching viscosities at 25.4° C. is shown in Table 11. A 50:50 mixture of 50 cS and 350 cS PDMS-1 was used to match the Actipol™ E-6 viscosity.

TABLE 11

| PDMS-1:Actipol ™ E-6 Ratio | % Drop |
|---|---|
| 90:10 | 11 |
| 70:30 | 20 |
| 50:50 | 20 |
| 30:70 | 14 |
| 10:90 | 2 |

EXAMPLE 12

The effect of component ratio on viscosity reduction for blends of PDMS-2 (139.25 cP) and Actipol™ E-6 (139.93 cP) with matching viscosities at 25.4° C. is shown in Table 12. A 92.5:7.5 mixture of PDMS-2 having viscosities of about 70 cP and about 2,000 cP, respectively, was used to match the Actipol™ E-6 viscosity.

TABLE 12

| PDMS-2:Actipol ™ E-6 Ratio | % Drop |
|---|---|
| 90:10 | 11 |
| 70:30 | 21 |
| 50:50 | 25 |
| 30:70 | 23 |
| 10:90 | 12 |

EXAMPLE 13

The effect of component ratio on viscosity reduction for blends of PDMS-3 (139.51 cP) and Actipol™ E-6 (139.93 cP) with matching viscosities at 25.4° C. is presented in Table 13. A 96.8:3.2 mixture of DMS-A21:DMS-A32 was used to match the Actipol™ E-6 viscosity.

TABLE 13

| PDMS-3:Actipol ™ E-6 Ratio | % Drop |
|---|---|
| 90:10 | 8 |
| 70:30 | 16 |
| 50:50 | 18 |
| 30:70 | 13 |
| 10:90 | <1 |

EXAMPLE 14

The effect of PDMS-1 molecular weight distribution on the viscosity reduction (% Drop) of 50:50 blends prepared from PDMS-1 and Actipol™ E-6 (139.5 cP) having matched viscosities at 25.4° C. is shown in Table 14. The first column of Table 14 indicates the weight ratio of polydimethylsiloxanes used to match the viscosity of the Actipol™ E-6 component as well as their respective kinematic viscosities. Thus, for example, the entry "50 (50 cS):50 (350 cS)" indicates that 50 weight parts of PDMS-1 having a kinematic viscosity of 50 cS was mixed with 50 weight parts of PDMS-1 having a kinematic viscosity of 350 cS to provide the PDMS-1 having an absolute viscosity substantially identical with that of the PIB component. The Actipol™ E-6 had a polydispersity of 1.08.

TABLE 14

| PDMS-1 Ratio (Kinematic Viscosity) | PDMS-1 Polydispersity | % DROP |
|---|---|---|
| 50 (50 cS):50 (350 cS) | 2.29 | 20 |
| 47 (100 cS):53 (200 cS) | 2.01 | 21 |
| 52 (10 cS):48 (1,000 cS) | 8.16 | 25 |
| 62.4 (2 cS):37.6 (10,000 cS) | 38.4 | 35 |

As can be seen from Table 14, the % Drop increases significantly when the polydispersity is large (e.g., when the polydimethylsiloxane component is a blend of very low and very high viscosity fluids).

EXAMPLE 15

The experiment of Example 14 was repeated wherein 50:50 blends of PDMS-1 and various PIB components having matched viscosities at room temperature (25.4° C.–25.5° C.) were used. In this case, the polydispersity (PD) of the PIB component is reported in the fourth column and the weight ratio and kinematic viscosities of the polydimethylsiloxane mixture used is shown in the first column of Table 15.

TABLE 15

| PDMS-1 Ratio (Kinematic Visc.) | PDMS PD | PIB Type | PIB PD | % DROP |
|---|---|---|---|---|
| 68 (20 cS):32 (50 cS) | 1.56 | Polysynlane ™ | 1.03 | 17 |
| 59.4 (10 cS):40.6 (100 cS) | 2.74 | Polysynlane ™ | 1.03 | 17 |
| 50 (50 cS):50 (350 cS) | 2.29 | Actipol ™ E-6 | 1.08 | 20 |
| 100 (50 cS) | 1.47 | Indopol ™ L-14 | 1.09 | 17 |

EXAMPLE 16

Experiments similar to those described in Example 15 were carried out wherein polydimethylsiloxanes having different end groups were blended with equal amounts of Actipol™ E-6 having a matched viscosity at 25.4° C. In Table 16, the first column again shows the weight ratio and kinematic viscosities of the polydimethylsiloxanes used.

TABLE 16

| PDMS Ratio (Kinematic Visc.) | PDMS Type | PDMS PD | % DROP |
|---|---|---|---|
| 97.5 (70 cS):7.5 (2,000 cS) | PDMS-2 | 3.20 | 25 |
| 50 (50 cS):50 (350 cS) | PDMS-1 | 2.29 | 20 |
| 96.8 (100 cS):3.2 (2,000 cS) | PDMS-3 | 2.55 | 18 |

EXAMPLE 17

Two experiments, similar to those described in Example 16, were carried out wherein polydimethylsiloxanes having different end groups were blended with equal amounts of Polysynlane™ having a matched viscosity at 25.5° C. In Table 17, the first column again shows the weight ratio and kinematic viscosities of the polydimethylsiloxanes used.

TABLE 17

| PDMS Ratio (Kinematic Visc.) | PDMS Type | PDMS PD | % DROP |
|---|---|---|---|
| 68 (20 cS):32 (50 cS) | PDMS-1 | 1.56 | 17 |
| 89 (20 cS):11 (50 cS) | PDMS-3 | 1.63 | 19 |

EXAMPLE 18

PDMS-1 having a viscosity of about 47 cP and a 4-ball wear scar $W_1$=2.1 mm was blended with Indopol™ L-14 also having a viscosity of about 47 cP and a wear scar $W_2$=0.8. The proportions used are shown in Table 18, wherein x represents the weight fraction of PDMS-1 in each blend. The results of 4-ball tests on the various blends are shown in Table 18 and compared with the calculated expected value based on a linear combination of the two components.

TABLE 18

| Weight Fraction of PDMS-1 (x) | Calculated Scar $W_2 + x(W_1 - W_2)$ (mm) | Measured Scar (mm) |
|---|---|---|
| 0 | 0.8 | 0.8 |
| 0.1 | 0.93 | 0.9 |
| 0.2 | 1.06 | 0.9 |
| 0.3 | 1.19 | 1.2 |
| 0.4 | 1.32 | 0.8 |
| 0.5 | 1.45 | 0.9 |
| 0.6 | 1.58 | 1.0 |
| 0.7 | 1.71 | 3.7 |
| 0.8 | 1.84 | 2.4 |
| 0.9 | 1.97 | 2.3 |
| 1.0 | 2.1 | 2.1 |

It can be seen from Table 18 that when x is about 0.7 or greater (i.e., >70% PDMS-1), the measured wear scar can be considerably greater than the linearly predicted value. When x is about 0.3 or less (i.e., <30% PDMS) the measured wear scar is approximately coincident with the calculated expected value. However, for this particular PDMS/PIB combination, the wear scar is unexpectedly lower than predicted in the approximate range of 0.3<x>0.7. As indicated in Example 1, above, the 50:50 blend shown in Table 18 had a viscosity of 39.38 cP, or about 17% lower than the viscosity of the individual components.

That which is claimed is:

1. A composition comprising a compatible blend of (A) a polydimethylsiloxane having an absolute viscosity V of no greater than 10,000 cP at 25° C.; and (B) a polybutylene having a number average molecular weight of about 100 to about 3,000 and an absolute viscosity substantially identical with V, wherein the ratio of said polydimethylsiloxane (A) to said polybutylene (B) is such that the absolute viscosity of said blend is less than the absolute viscosity of either component (A) or (B), all of the viscosities being measured at the same operating temperature and pressure.

2. The composition according to claim 1, wherein said polybutylene is predominantly polyisobutylene.

3. The composition according to claim 2, wherein said polybutylene has one epoxy end group.

4. The composition according to claim 1, wherein said polydimethylsiloxane has a viscosity of 10 to 500 cP at 25° C.

5. The composition according to claim 1, wherein said polybutylene has a number average molecular weight of 300 to 500.

6. The composition according to claim 1, wherein the weight ratio of said polydimethylsiloxane (A) to said polybutylene (B) is 10:90 to 90:10.

7. The composition according to claim 1, wherein the polydispersity of said polydimethylsiloxane (A) is >10.

8. The composition according to claim 2, wherein said polydimethylsiloxane has a viscosity of 10 to 500 cP at 25° C.

9. The composition according to claim 8, wherein said polybutylene has a number average molecular weight of 300 to 500.

10. The composition according to claim 9, wherein the weight ratio of said polydimethylsiloxane (A) to said polybutylene (B) is 10:90 to 90:10.

11. The composition according to claim 10, wherein the polydispersity of said polydimethylsiloxane (A) in >10.

12. The composition according to claim 1, wherein said polybutylene (B) has an absolute viscosity of 0.75 V to 1.25 V.

13. The composition according to claim 7, wherein said polybutylene (B) has an absolute viscosity of 0.75 V to 1.25 V.

14. The composition according to claim 11, wherein said polybutylene (B) has an absolute viscosity of 0.75 V to 1.25 V.

15. A method for moving a member positioned within an enclosed chamber comprising transmitting pressure to said member through a hydraulic fluid having a composition according to claim 1.

16. A method for reducing the frictional wear of metal surfaces, said method comprising applying to at least a portion of a first metal surface, in an area which contacts a second metal surface, the composition according to claim 1.

17. In a method for pressurizing a gas comprising compressing said gas in a gas compressor which is lubricated by a compressor fluid, the improvement comprising using the composition according to claim 1 as the compressor fluid.

18. A method for lubricating a thread comprising applying the composition according to claim 1 to said thread.

19. The method according to claim 18, wherein said thread is formed from a fiber selected from the group consisting of polyesters, nylon, polypropylene, polyurethanes, acrylics and cellulosics.

* * * * *